US009445693B2

(12) United States Patent
Nelson

(10) Patent No.: US 9,445,693 B2
(45) Date of Patent: Sep. 20, 2016

(54) BATH BENCH WITH LATERAL TRANSFER EXTENSION

(71) Applicant: HOMER DEPOT PRODUCT AUTHORITY, LLC, Atlanta, GA (US)

(72) Inventor: Michael Nelson, Peachtree City, GA (US)

(73) Assignee: Home Depot Product Authority, LLC, Atlanta, GA (US)

( * ) Notice: Subject to any disclaimer, the term of this patent is extended or adjusted under 35 U.S.C. 154(b) by 15 days.

(21) Appl. No.: 13/799,937

(22) Filed: Mar. 13, 2013

(65) Prior Publication Data

US 2014/0259361 A1 Sep. 18, 2014

(51) Int. Cl.
*A47K 3/022* (2006.01)
*A47K 3/12* (2006.01)

(52) U.S. Cl.
CPC ..... *A47K 3/122* (2013.01)

(58) Field of Classification Search
CPC ..... A47K 3/122
USPC ..... 4/578.1, 579
See application file for complete search history.

(56) References Cited

U.S. PATENT DOCUMENTS

| | | | | |
|---|---|---|---|---|
| 2,813,276 | A | 11/1957 | Lanza | 4/185 |
| 4,087,127 | A | 5/1978 | Lotta | 297/14 |
| 4,391,006 | A | 7/1983 | Smith | 4/559 |
| 4,472,844 | A | 9/1984 | Mace | 4/579 |
| 4,475,256 | A | 10/1984 | Hatala | 4/562 |
| 5,185,892 | A * | 2/1993 | Mitchell | 4/578.1 |
| 5,475,880 | A | 12/1995 | Guenther | 4/578 |
| 5,561,868 | A | 10/1996 | Campbell | 4/560.1 |
| 6,065,251 | A | 5/2000 | Kindrick | 52/36.4 |
| 6,305,741 | B1 | 10/2001 | Fernandez | |
| D495,506 | S * | 9/2004 | Self et al. | D6/362 |
| 6,807,690 | B1 | 10/2004 | Satterfield | 4/578.1 |
| 6,935,276 | B2 | 8/2005 | Powers | |
| 7,080,417 | B2 | 7/2006 | Jiang | 4/578.1 |
| 7,155,757 | B1 | 1/2007 | Zamora, Jr. | 4/579 |
| 8,181,285 | B1 | 5/2012 | Jackson | |
| 2009/0139021 | A1 | 6/2009 | Cheng | 4/578.1 |
| 2010/0031436 | A1 | 2/2010 | Corcoran | 4/578.1 |
| 2010/0180403 | A1 * | 7/2010 | Wei et al. | 16/371 |
| 2011/0283450 | A1 | 11/2011 | Fainberg | 4/568 |
| 2013/0117928 | A1 * | 5/2013 | Hardie | 4/611 |

FOREIGN PATENT DOCUMENTS

| | | |
|---|---|---|
| CA | 1243592 A | 10/1988 |
| WO | WO 01/70088 | 9/2001 |

OTHER PUBLICATIONS

U.S. Appl. No. 29/448,633, Nelson.
Office Action received re Chinese Patent Appl. No. 201410165497.2, dated Sep. 30, 2015, 10 pgs.
Office Action received re Canadian Patent Appl. No. 2,846,023, dated May 29, 2015, 6 pgs.

* cited by examiner

*Primary Examiner* — Huyen Le
*Assistant Examiner* — Christine Skubinna
(74) *Attorney, Agent, or Firm* — Greenberg Traurig, LLP

(57) ABSTRACT

This application includes embodiments of apparatuses (e.g., bath benches) for improving accessibility to a bathtub. Some embodiments include a bath bench with a primary deck and a folding lateral transfer extension (secondary deck). The secondary deck may be coupled to the primary deck by a dual-axis hinge.

11 Claims, 10 Drawing Sheets

BATH BENCH WITH LATERAL TRANSFER EXTENSION

BACKGROUND

1. Field of the Invention

The invention relates generally to accessibility and, more particularly, but not by way of limitation, to a bath bench with a lateral transfer extension for facilitating exit and entry into a bathtub (e.g., for persons with limited mobility).

2. Description of Related Art

Examples of bath benches are disclosed in (1) U.S. Pat. No. 2,813,276; (2) U.S. Pat. No. 4,087,127; (3) U.S. Pat. No. 4,391,006; (4) U.S. Pat. No. 4,472,844; (5) U.S. Pat. No. 4,475,256; (6) U.S. Pat. No. 5,475,880; (6) U.S. Pat. No. 5,561,868; (7) U.S. Pat. No. 6,065,251; (8) U.S. Pat. No. 6,807,690; (9) U.S. Pat. No. 7,080,417; (10) U.S. Pat. No. 7,155,757; (11) U.S. Pat. No. 8,181,285; (12) Patent App. Pub. No. US 2009/0139021; (13) Patent App. Pub. No. US 2010/0031436; (14) Patent App. Pub. No. US 2011/0283450; and (15) PCT App. Pub. No. WO 01/70088.

SUMMARY

This disclosure includes embodiments of apparatuses and methods.

Some embodiments of the present apparatuses comprise: a mounting member; a primary deck pivotally coupled to the mounting member; and one or more telescoping primary legs pivotally coupled to the primary deck and configured to be moved between (i) a first position in which the one or more primary legs are substantially parallel to the primary deck, and (ii) a second position in which the one or more primary legs are substantially perpendicular to the primary deck; where the mounting member is configured to be coupled to a wall bordering a bathtub above an upper rim of the bathtub such that the primary legs, in their second position, can extend downward from the bottom of the primary deck to a floor of the bathtub to support the primary deck. In some embodiments, the mounting member is configured to be coupled to a wall bordering an end of the bathtub such that the primary deck pivots relative to the mounting member around a pivot axis that is substantially perpendicular to the length of the bathtub. In some embodiments, the primary deck has a first end pivotally coupled to the mounting member, a second end, a first side, a second side, a width between the first and second sides, and a length between the first and second ends that is greater than the width. Some embodiments further comprise: a secondary deck pivotally coupled to the first side of the primary deck and movable between at least: (i) a first position in which the secondary deck extends toward the second side of the primary deck, and (ii) a second position in which the secondary deck extends away from the second side of the primary deck. In some embodiments, the secondary deck, in its second position, is configured to extend over a lateral rim of the bathtub over which the apparatus is coupled.

Some embodiments of the present apparatuses further comprise: one or more secondary legs pivotally coupled to the secondary deck and configured to be moved between (i) a first position in which the one or more secondary legs are substantially parallel to the secondary deck, and (ii) a second position in which the one or more secondary legs are substantially perpendicular to the secondary deck. In some embodiments, the one or more secondary legs comprise one or more telescoping legs. In some embodiments, the secondary deck is movable between at least (i) a first position in which the secondary deck extends toward the second side of the primary deck, and (ii) a second position in which the secondary deck extends away from the second side of the primary deck, and (iii) a third position in which the secondary deck extends downwardly relative to an upper surface of the primary deck and at a non-parallel angle to the primary deck. In some embodiments, the secondary deck, in its third position, is configured to be spaced apart from the lateral rim of the bathtub to permit a shower curtain to pass between the apparatus and the lateral rim of the bathtub. In some embodiments, the mounting member is coupled to a wall bordering an end of a bathtub above the lateral rim of the bathtub such that the primary deck pivots relative to the mounting member around a pivot axis that is substantially perpendicular to the length of the bathtub.

Some embodiments of the present apparatuses comprise: a mounting member; a primary deck having a first end pivotally coupled to the mounting member, a second end, a first side, a second side, a width between the first and second sides, and a length between the first and second ends; one or more primary legs pivotally coupled to the primary deck and configured to be moved between (i) a first position in which the one or more primary legs are substantially parallel to the primary deck, and (ii) a second position in which the one or more primary legs are substantially perpendicular to the primary deck; and a secondary deck pivotally coupled to the first side of the primary deck and movable between at least: (i) a first position in which the secondary deck extends toward the second side of the primary deck, and (ii) a second position in which the secondary deck extends away from the second side of the primary deck; where the mounting member is configured to be coupled to a wall bordering a bathtub above an upper rim of the bathtub such that the primary legs, in their second position, can extend downward from the bottom of the primary deck to a floor of the bathtub to support the primary deck.

In some embodiments of the present apparatuses, the mounting member is configured to be coupled to a wall bordering an end of the bathtub such that the primary deck pivots relative to the mounting member around a pivot axis that is substantially perpendicular to the length of the bathtub. In some embodiments, the secondary deck, in its second position, is configured to extend over a lateral rim of the bathtub over which the apparatus is coupled. Some embodiments further comprise: one or more secondary legs pivotally coupled to the secondary deck and configured to be moved between (i) a first position in which the one or more secondary legs are substantially parallel to the secondary deck, and (ii) a second position in which the one or more secondary legs are substantially perpendicular to the secondary deck. In some embodiments, the one or more secondary legs comprise one or more telescoping legs. In some embodiments, the secondary deck is movable between at least (i) a first position in which the secondary deck extends toward the second side of the primary deck, and (ii) a second position in which the secondary deck extends away from the second side of the primary deck, and (iii) a third position in which the secondary deck extends downwardly relative to an upper surface of the primary deck and at a non-parallel angle to the primary deck. In some embodiments, the secondary deck, in its third position, is configured to be spaced apart from the lateral rim of the bathtub to permit a shower curtain to pass between the apparatus and the lateral rim of the bathtub. In some embodiments, the mounting member is coupled to a wall bordering an end of a bathtub above the lateral rim of the bathtub such that the primary deck pivots relative to the mounting member around a pivot axis that is substantially perpendicular to the length of the bathtub.

Some embodiments of the present apparatuses comprise: a primary deck; one or more primary legs configured to support the primary deck over a portion of a bathtub; a secondary deck; and a dual-axis hinge coupling the secondary deck to the primary deck such that the secondary deck is pivotable relative to the primary deck around a first pivot axis and around a second pivot axis that is not parallel to the first pivot axis. Some embodiments further comprise: one or more legs configured to support the primary deck above a floor of a bathtub.

The term "coupled" is defined as connected, although not necessarily directly, and not necessarily mechanically; two items that are "coupled" may be unitary with each other. The terms "a" and "an" are defined as one or more unless this disclosure explicitly requires otherwise. The term "substantially" is defined as largely but not necessarily wholly what is specified (and includes what is specified; e.g., substantially 90 degrees includes 90 degrees and substantially parallel includes parallel), as understood by a person of ordinary skill in the art. In any disclosed embodiment, the terms "substantially," "approximately," and "about" may be substituted with "within [a percentage] of" what is specified, where the percentage includes 0.1, 1, 5, and 10 percent.

Further, a device or system that is configured in a certain way is configured in at least that way, but it can also be configured in other ways than those specifically described.

The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, an apparatus that "comprises," "has," "includes" or "contains" one or more elements possesses those one or more elements, but is not limited to possessing only those elements. Likewise, a method that "comprises," "has," "includes" or "contains" one or more steps possesses those one or more steps, but is not limited to possessing only those one or more steps.

Any embodiment of any of the apparatuses, systems, and methods can consist of or consist essentially of—rather than comprise/include/contain/have—any of the described steps, elements, and/or features. Thus, in any of the claims, the term "consisting of" or "consisting essentially of" can be substituted for any of the open-ended linking verbs recited above, in order to change the scope of a given claim from what it would otherwise be using the open-ended linking verb.

The feature or features of one embodiment may be applied to other embodiments, even though not described or illustrated, unless expressly prohibited by this disclosure or the nature of the embodiments.

Details associated with the embodiments described above and others are described below.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers. The embodiments of the apparatuses and their components shown in the figures are drawn to scale for at least the embodiment shown, unless stated otherwise.

DESCRIPTION OF ILLUSTRATIVE EMBODIMENTS

Figure 1:
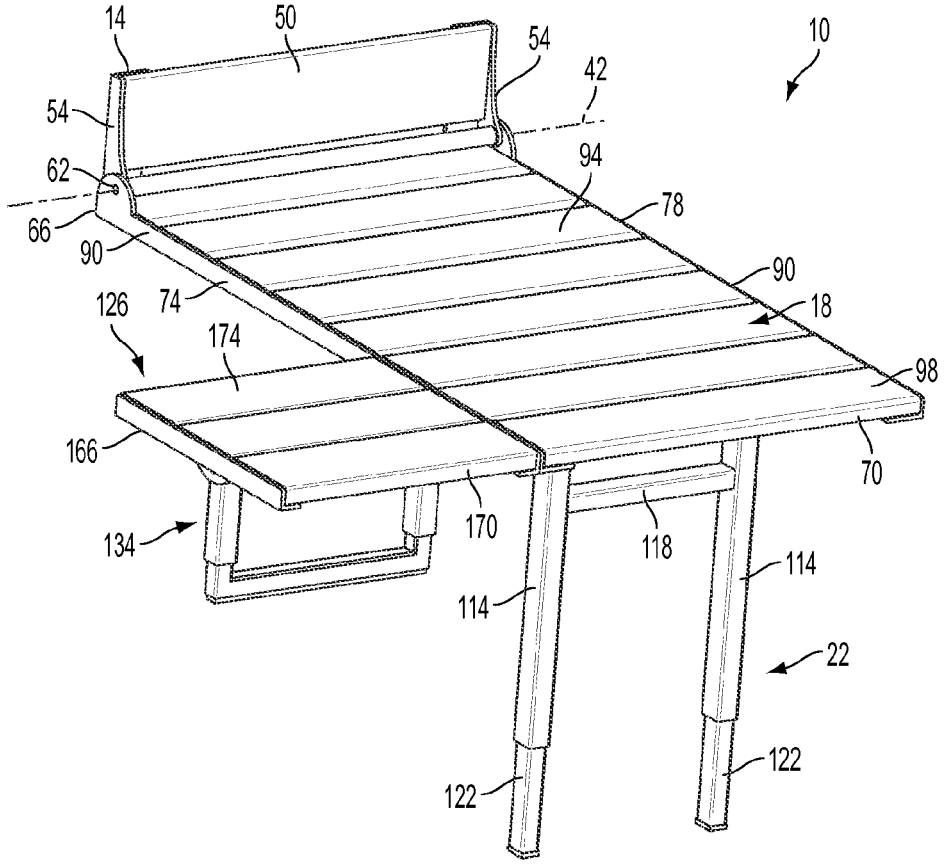
FIGS. 1-2 depict upper and lower perspective views, respectively, of one embodiment of the bath benches.
Figure 2:
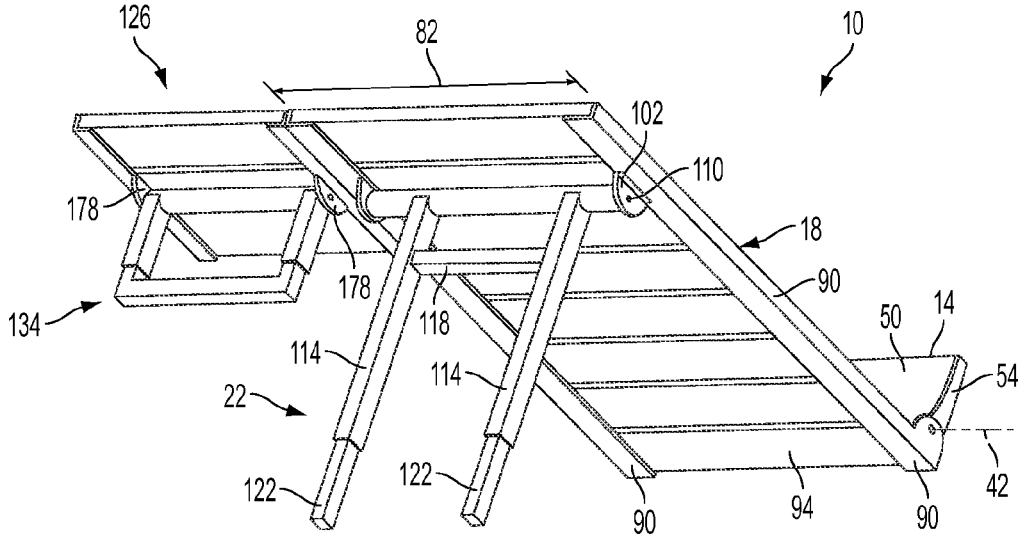
Figure 3A:
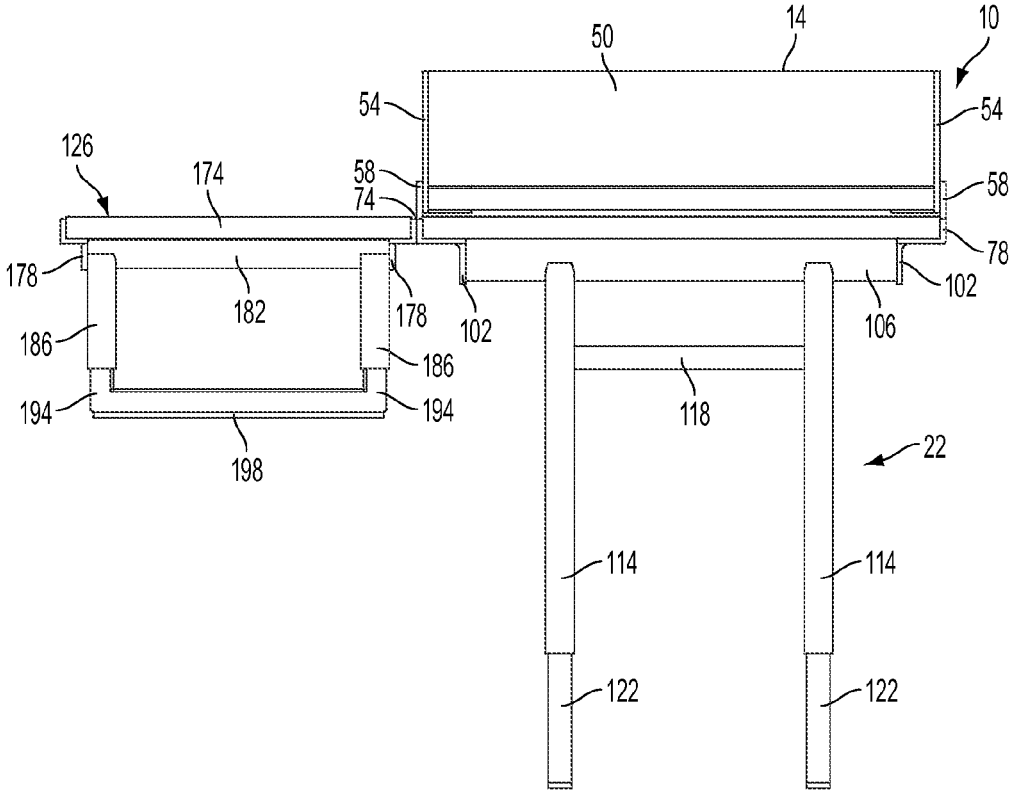
FIGS. 3A-3B depict front and left side views, respectively, of the bath bench of FIGS. 1-2.
Figure 3B:
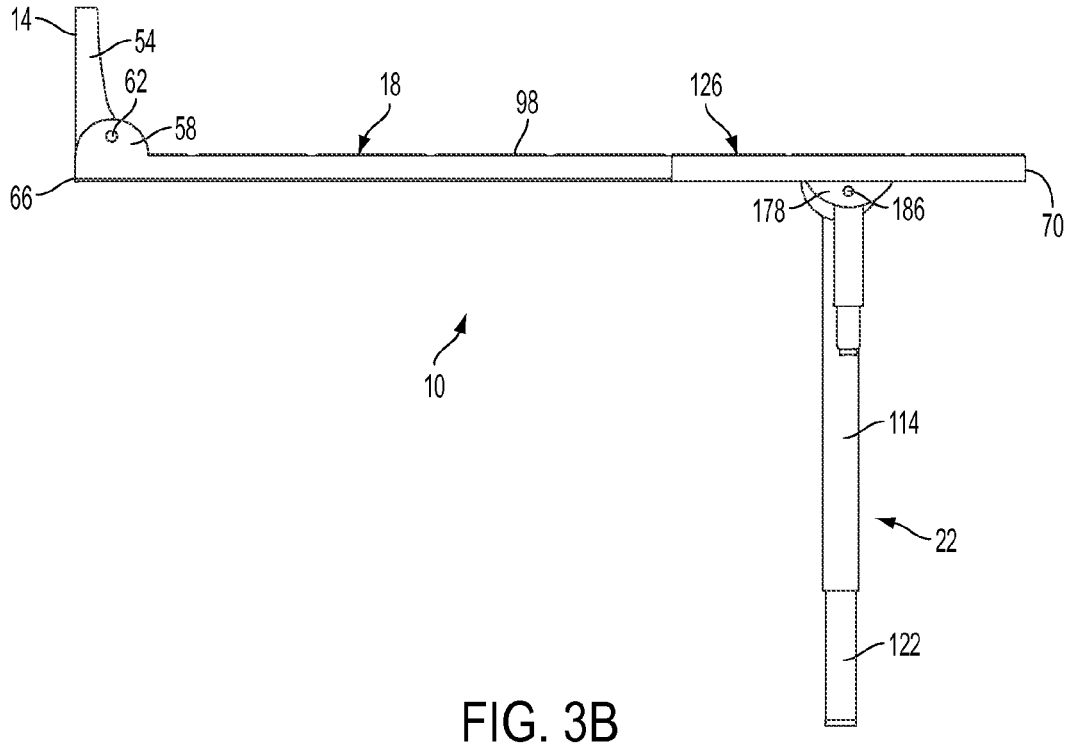
Figure 3D:
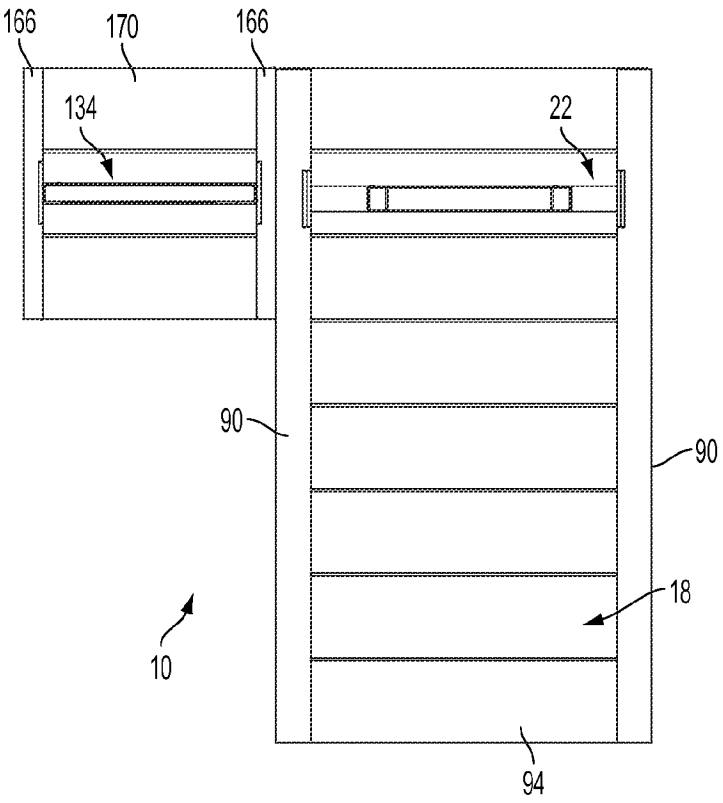
FIGS. 3C-3D depict top and bottom views, respectively, of the bath bench of FIGS. 1-2.
Figure 3C:
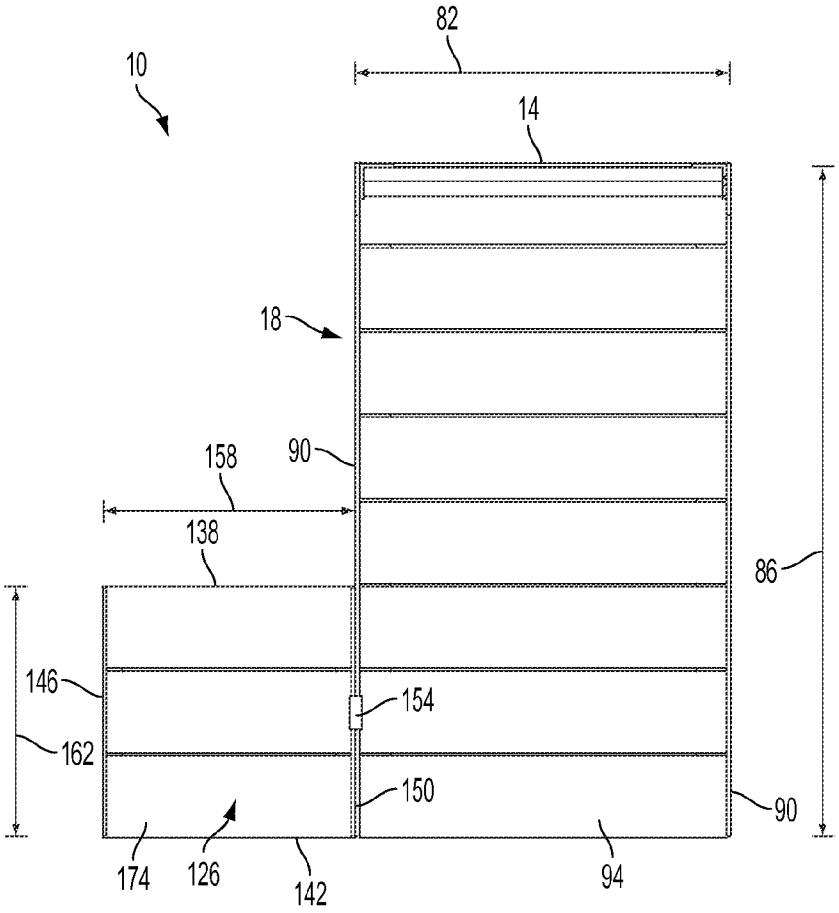
Figure 4A:
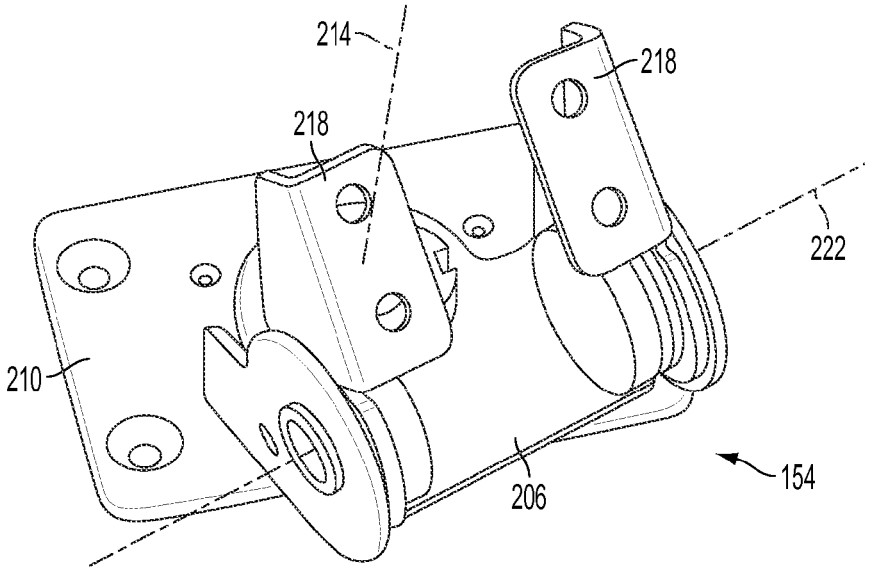
FIGS. 4A-4B depict alternate versions of dual-axis hinges suitable for the bath bench of FIGS. 1-2.
Figure 4B:
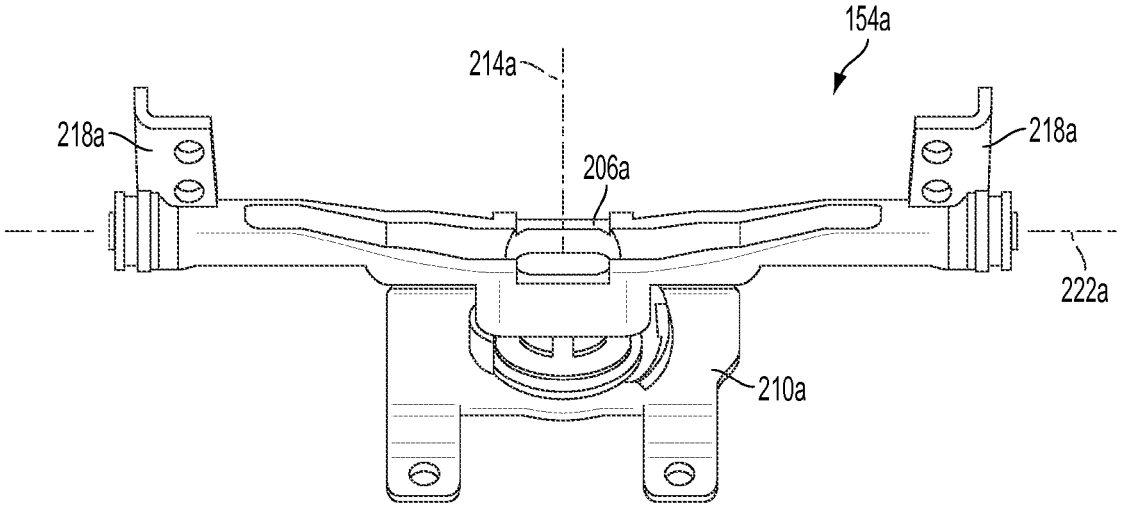
Figure 5:
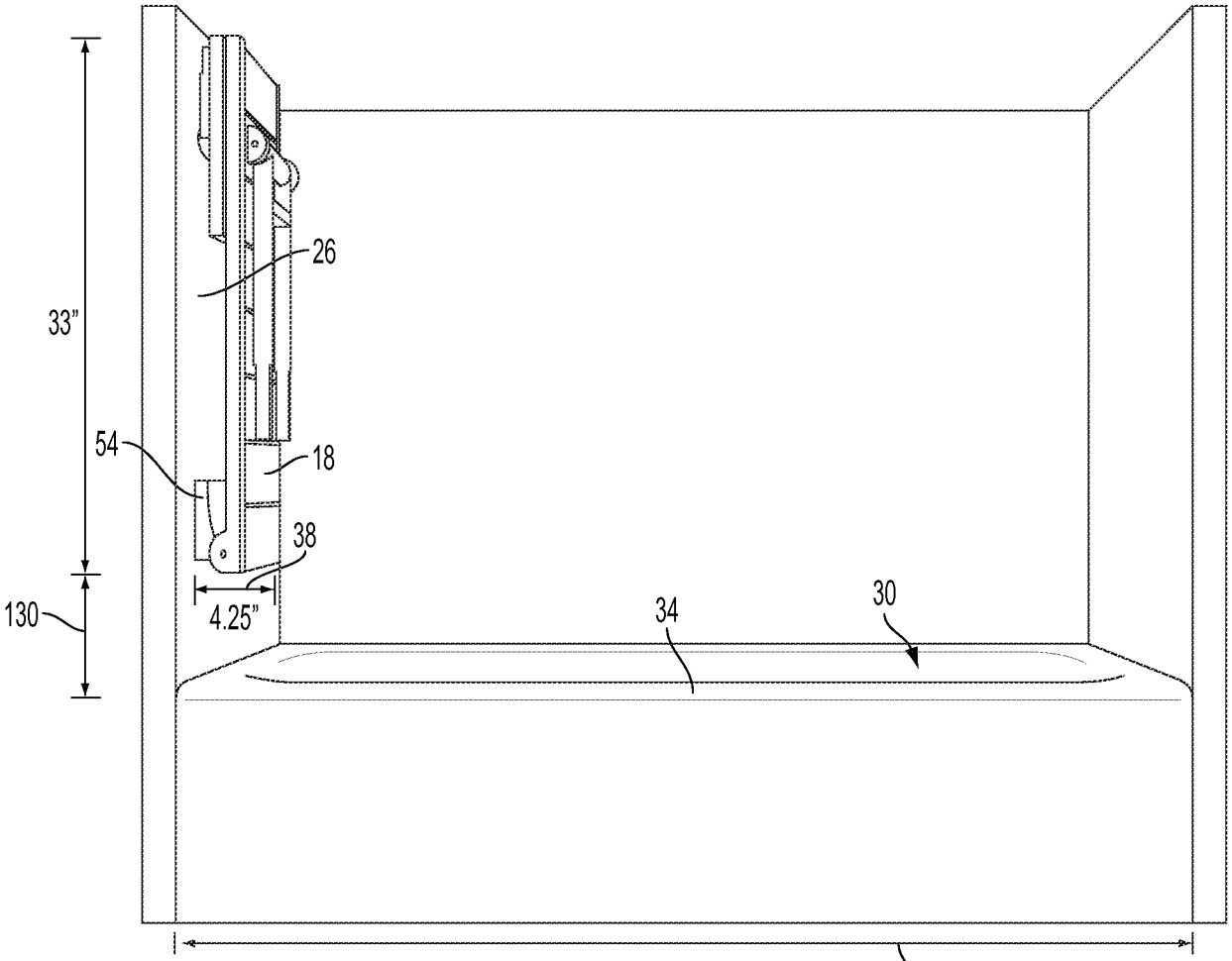
FIG. 5 depicts the bath bench of FIGS. 1-2 in a folded configuration mounted above a bathtub.

Referring now to the drawings, and more particularly to FIGS. 1-5, shown therein and designated by the reference numeral 10 is one embodiment of the apparatuses or bath benches. FIG. 1 shows a perspective view of bench 10 from the top and front; FIG. 2 shows a view of bench 10 from the bottom and front; FIG. 3A shows a front view of bench 10; FIG. 3B shows a side view of bench 10; FIGS. 3C and 3D show top and bottom views, respectively, of bench 10; FIGS. 4A and 4B show different embodiments of dual-axis hinges that be part of bench 10; and FIG. 5 shows bench 10 in a folded configuration, mounted above a bathtub.

In the embodiment shown in these figures, and as is visible in FIGS. 1, 2, and 3B, bench 10 comprises a mounting member 14; a primary deck or bench 18 pivotally coupled to the mounting member; and one or more primary legs 22 pivotally coupled to the primary deck and configured to be moved between (i) a first position (FIG. 5) in which primary leg(s) 22 are substantially parallel to the primary deck, and (ii) a second position (FIG. 1) in which primary leg(s) 22 are substantially perpendicular to primary deck 18. Primary leg(s) 22 are telescoping in the depicted embodiment, as discussed in further detail below.

As shown, for example, in FIG. 5, mounting member 14 is configured to be coupled to a wall 26 bordering a bathtub 30 above an upper rim 34 of the bathtub such that primary legs 22, in their second position, can extend downward from primary deck 18 to a floor of the bathtub (such as floor 234, which can be seen in FIGS. 6A and 6B) to support primary deck 18. For example, as shown in FIG. 5, mounting member 14 is configured to be coupled to a wall bordering an end 38 of the bathtub such that primary deck 18 pivots relative to mounting member 14 around a pivot axis 42 that is substantially perpendicular to length 46 of the bathtub.

In the embodiment shown, mounting member 14 comprises a sheet of metal, such as, for example, stainless steel, or another suitably durable material formed to have a central portion 50 and flanges 54 on either end of central portion 50. In this embodiment, central portion 50 is substantially planar; in other embodiments, central portion 50 can have any suitable shape. In the embodiment shown, flanges 54 are pivotally coupled to corresponding flanges 58 of primary deck 18 by an axle 62. In other embodiments, flanges 54 can be coupled to flanges 58 by multiple rivets, bolts, or other fasteners, and/or primary deck 18 can be pivotally coupled to mounting member by any structure or arrangement that permits primary deck 18 to pivot relative to mounting member 14, as described in this disclosure.

In the embodiment shown, primary deck 18 has a first end 66 pivotally coupled to mounting member 14, a second end 70, a first side 74, a second side 78. A width 82 extends between first and second sides 74, 78, and a length 86 extends between first and second ends 66, 70. In this embodiment, length 86 is greater than width 82. As shown, flanges 58 are disposed at first end of primary deck 18. In the embodiment shown, primary deck 18 comprises a pair of lateral frame members 90 along first and second sides 74, 78 each having an L-shaped cross-sectional shape, and a plurality of composite (or plastic or other rigid material that resists corrosion and rotting) deck boards 94 extending between and into the L-shaped cross-section of members 90. In this embodiment, boards 94 are secured to members 90 by adhesive and/or other fasteners, such as, for example, screws, bolts, rivets, or the like. In this embodiment, boards 94 cooperate to define an upper surface 98 of primary deck 18. In other embodiments, boards 94 may be substituted with a solid panel defining upper surface 98 and that may be coupled directly to mounting member 14 (e.g., without frame members 90). For example, in some embodiments, a sheet metal, such as, for example, stainless steel, may be bent to include two or more layers defining corrugations or other stiffening structures under a planar layer that defines upper surface 98.

In the embodiment shown, frame members 90 include additional flanges 102 that extend downwardly. In this embodiment, primary leg(s) 22 comprise a tubular carrier 106 pivotally coupled to and between flanges 102 by an axle 110, two tubular leg members 114 extending from carrier 106, and a cross member 118 extending between leg members 114. In this embodiment, carrier 106, leg members 114, and cross member 118 are welded or otherwise connected together in fixed relation. In the embodiment shown, primary leg(s) 22 further are telescoping and comprise extension members 122 slidably disposed in leg members 114 to permit adjustment of the length of primary leg(s) 22 to account for different bathtub heights and/or mounting heights above a bathtub. Extension members 122 may be secured relative to leg members 114 in any suitable fashion, such as, for example, by pins extending through leg members 114 and extension members 122, such as, for example, via holes disposed at known intervals to permit adjustment in corresponding increments. In other embodiments, primary leg(s) 22 are not adjustable (extension members 122 may be omitted).

In the embodiment shown, bench 10 further comprises: a secondary deck or transfer bench 126 pivotally coupled to first side 74 of primary deck 18 and movable between at least: (i) a first position (FIGS. 5 and 6A) in which secondary deck 126 extends toward second side 78 of primary deck 18 (and is substantially parallel to primary deck 18), and (ii) a second position (FIG. 6C) in which secondary deck 126 extends away from second side 78 of primary deck 18 (and is substantially parallel to primary deck 18). As shown in FIG. 6C, secondary deck 126, in its second position, is configured to extend over a lateral rim 34 of bathtub (e.g., 30) over which bench 10 is coupled. Some embodiments are configured to be mounted at a height 130 above rim 34 of the bathtub such that secondary deck 126 can rest directly on rim 34. In the embodiment shown, however, bench 10 further comprises: one or more secondary legs 134 pivotally coupled to secondary deck 126 and configured to be moved between (i) a first position (FIGS. 6B and 6D) in which secondary leg(s) 134 are collapsed relative to and substantially parallel to secondary deck 126, and (ii) a second position (FIGS. 1 and 6C) in which secondary leg(s) 134 are substantially perpendicular to secondary deck 126. In some embodiments, secondary leg(s) 134 comprise one or more telescoping legs to permit adjustment of the overall length of secondary leg(s) 134.

In the embodiment shown, secondary deck 126 has a first end 138, a second end 142, a first side 146, a second side 150 pivotally coupled to primary deck 18 by a dual-axis hinge 154. A width 158 extends between first and second sides 146, 150, and a length 162 extends between first and second ends 138, 142. In this embodiment, length 162 is equal to width 158. In the embodiment shown, secondary deck 126 comprises a pair of lateral frame members 166 along first and second sides 146, 150 each having an L-shaped cross-sectional shape, and a plurality of composite (or plastic or other rigid material that resists corrosion and rotting) deck boards 170 extending between and into the L-shaped cross-section of members 166, similar to those of primary deck 18. In this embodiment, boards 170 are secured to members 166 by adhesive and/or other fasteners, such as, for example, screws, bolts, rivets, or the like. In this embodiment, boards 170 cooperate to define an upper surface 174 of secondary deck 126 that, in the depicted embodiment, is substantially co-planar with upper surface 98 of primary deck 18 when primary deck 18 and secondary deck 126 are both in deployed positions, as in FIG. 6C. In other embodiments, boards 170 may be substituted with a solid panel defining upper surface 174. For example, in some embodiments, a sheet metal such as stainless steel may be bent to include two or more layers defining corrugations or other stiffening structures under a planar layer that defines upper surface 174.

In the embodiment shown, frame members 166 include additional flanges 178 that extend downwardly. In this embodiment, secondary leg(s) 134 comprise a tubular carrier 182 pivotally coupled to and between flanges 178 by an axle 186, two tubular leg members 190 extending from carrier 182. In this embodiment, carrier 182 and leg members 190 are welded or otherwise connected together in fixed relation. In the embodiment shown, secondary leg(s) 134 further are telescoping and comprise extension members 194 and a cross member 198 extending between and in welded or otherwise fixed to extension members 194. In this embodiments, extension members 194 are slidably disposed in leg members 190 to permit adjustment of the length of secondary leg(s) 134 to account for different bathtub heights and/or mounting heights above a bathtub. Extension members 194 may be secured relative to leg members 190 in any suitable fashion, such as, for example, by pins extending through leg members 190 and extension members 194, such as, for example, via holes disposed at known intervals to permit adjustment in corresponding increments. In other embodiments, secondary leg(s) 134 are not adjustable (extension members 194 may be omitted).

In the embodiment shown, secondary deck 126 is movable between at least (i) a first position (FIGS. 5 and 6A) in which secondary deck 126 extends toward second side 78 of primary deck 18, (ii) a second position (FIG. 6C) in which secondary deck 126 extends away from second side 78 of primary deck 18, and (iii) a third position (FIG. 6E) in which secondary deck 126 extends downwardly relative to upper surface 98 of primary deck 18 and at a non-parallel (e.g., perpendicular) angle to primary deck 18. For example, in the embodiment shown, secondary deck 126 is substantially perpendicular to upper surface 98 when secondary deck 126 is in its third position. In the embodiment shown, secondary deck 126, in its third position (FIG. 6E), is configured to be spaced apart from a lateral rim 34 of a bathtub over which bench 10 is coupled to permit a shower curtain to pass between bench 10 and lateral rim 34 of the bathtub, such as in space 202. For example, in the embodiment shown, movement of secondary deck 126 relative to the primary deck between these three positions is facilitated by a dual-axis hinge 154 that couples secondary deck 126 to primary deck 18.

FIG. 4A depicts a first embodiment of a dual-axis hinge 154 suitable for use with at least some of the embodiments. In this embodiments, hinge 154 includes a body 206 pivotally coupled to a first mount 210 such that body 206 can pivot relative to mount 210 around a first pivot axis 214, and body 206 is pivotally coupled to a second mount 218 such that body 206 can also pivot relative to second mount 218 around a second pivot axis 222 that is not parallel (e.g., is perpendicular, as shown) to first pivot axis 214. For example, in the embodiment shown, first mount 210 includes a flange and second mount 218 includes two flanges. In this embodiment, first mount 210 is configured to be coupled to first side 74 of primary deck 18 with first pivot axis 214 extending parallel to width 82 of primary deck 18, and second mount 218 is configured to be coupled to secondary deck 126 with second pivot axis 222 substantially parallel to and level with upper surface 98 (and extending parallel to length 86 of) primary deck 18 when primary deck 18 and secondary deck 126 are in the deployed configuration of FIG. 6C. It should appreciated that the particular configurations and shapes of mounts 210 and 218 may be varied and/or adjusted to position hinge 154 and second pivot axis 222 relative to primary deck 18 and secondary deck 126 to permit the functionality described in this disclosure and depicted in FIGS. 6A-6E.

FIG. 4B depicts a second embodiment of a dual-axis hinge 154*a* suitable for use with at least some of the embodiments. In this embodiments, hinge 154*a* includes a body 206*a* pivotally coupled to a first mount 210*a* such that body 206*a* can pivot relative to mount 210*a* around a first pivot axis 214*a*, and body 206*a* is pivotally coupled to a second mount 218*a* such that body 206*a* can also pivot relative to second mount 218*a* around a second pivot axis 222*a* that is not parallel (e.g., is perpendicular, as shown)) to first pivot axis 214*a*. For example, in the embodiment shown, first mount 210*a* includes a flange and second mount 218*a* includes two flanges. In this embodiment, first mount 210*a* is configured to be coupled to first side 74 of primary deck 18 with first pivot axis 214*a* extending parallel to width 82 of primary deck 18, and second mount 218*a* is configured to be coupled to secondary deck 126 with second pivot axis 222*a* substantially parallel to and level with upper surface 98 (and extending parallel to length 86 of) primary deck 18 when primary deck 18 and secondary deck 126 are in the deployed configuration of FIG. 6C. It should appreciated that, as with hinge 154, the particular configurations and shapes of mounts 210*a* and 218*a* may be varied and/or adjusted to position hinge 154*a* and second pivot axis 222*a* relative to primary deck 18 and secondary deck 126 to permit the functionality described in this disclosure and depicted in FIGS. 6A-6E.

Figure 6A:
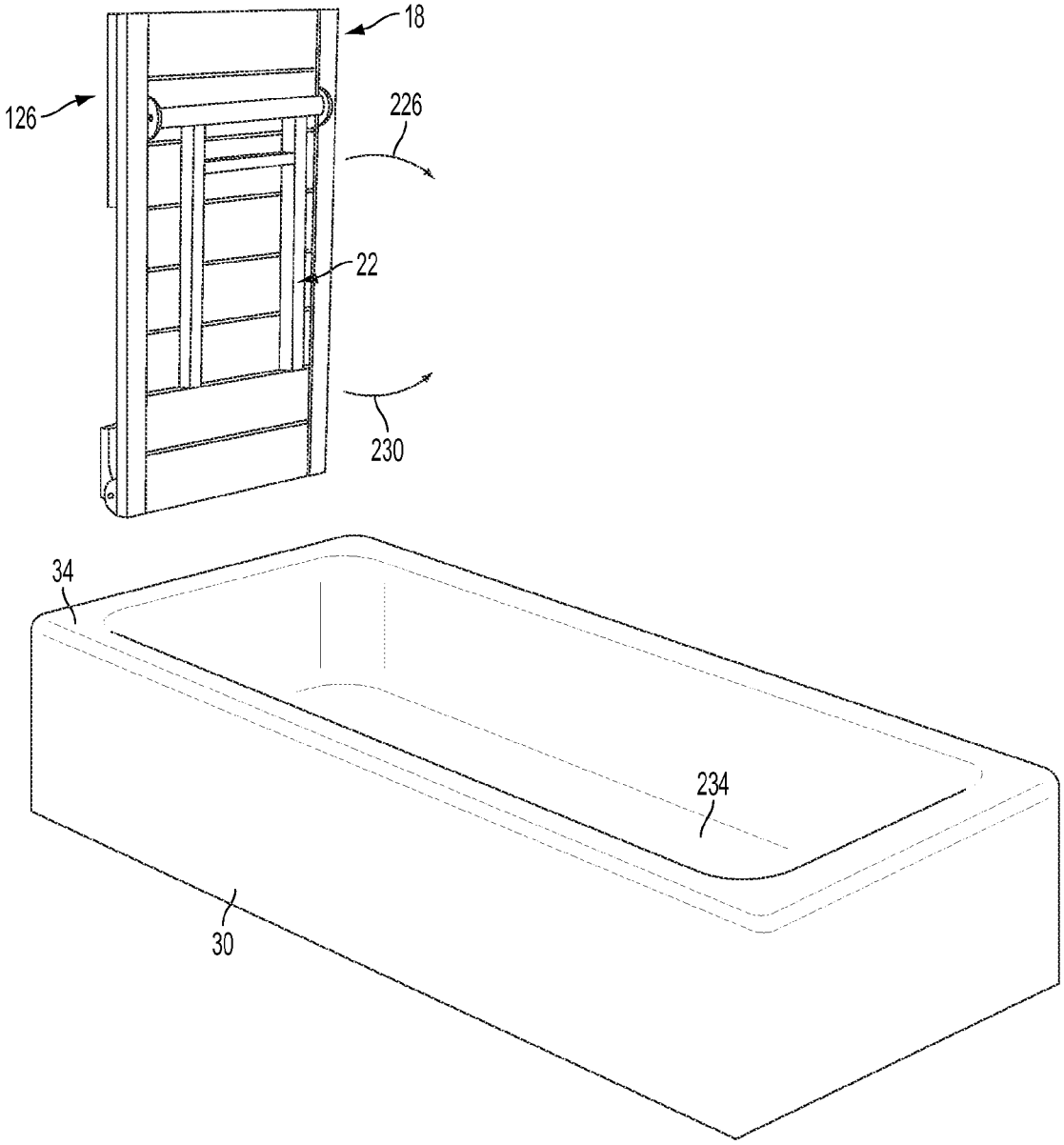
FIGS. 6A-6E depict perspective views of the bath bench and bathtub of FIG. 4 with the bath bench in various configurations relative to the bathtub.
Figure 6B:
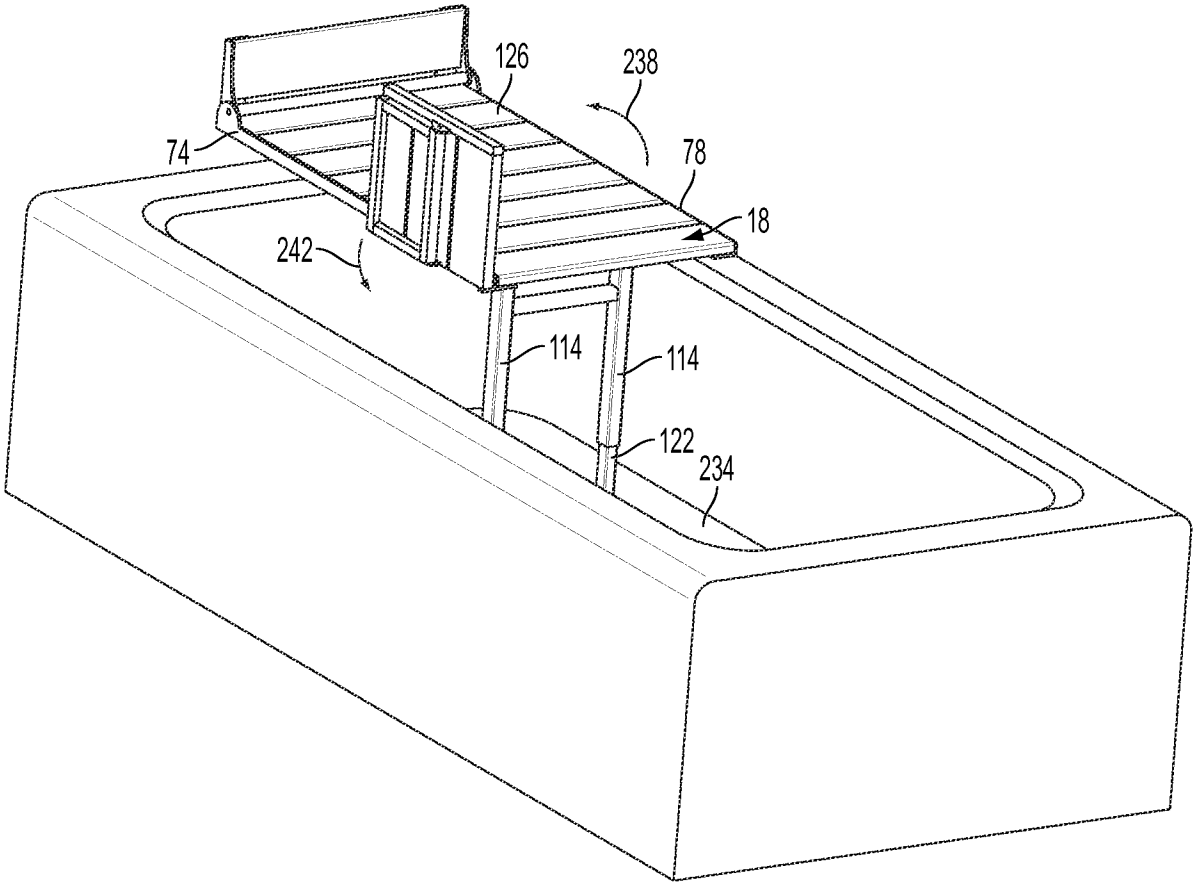
Figure 6C:
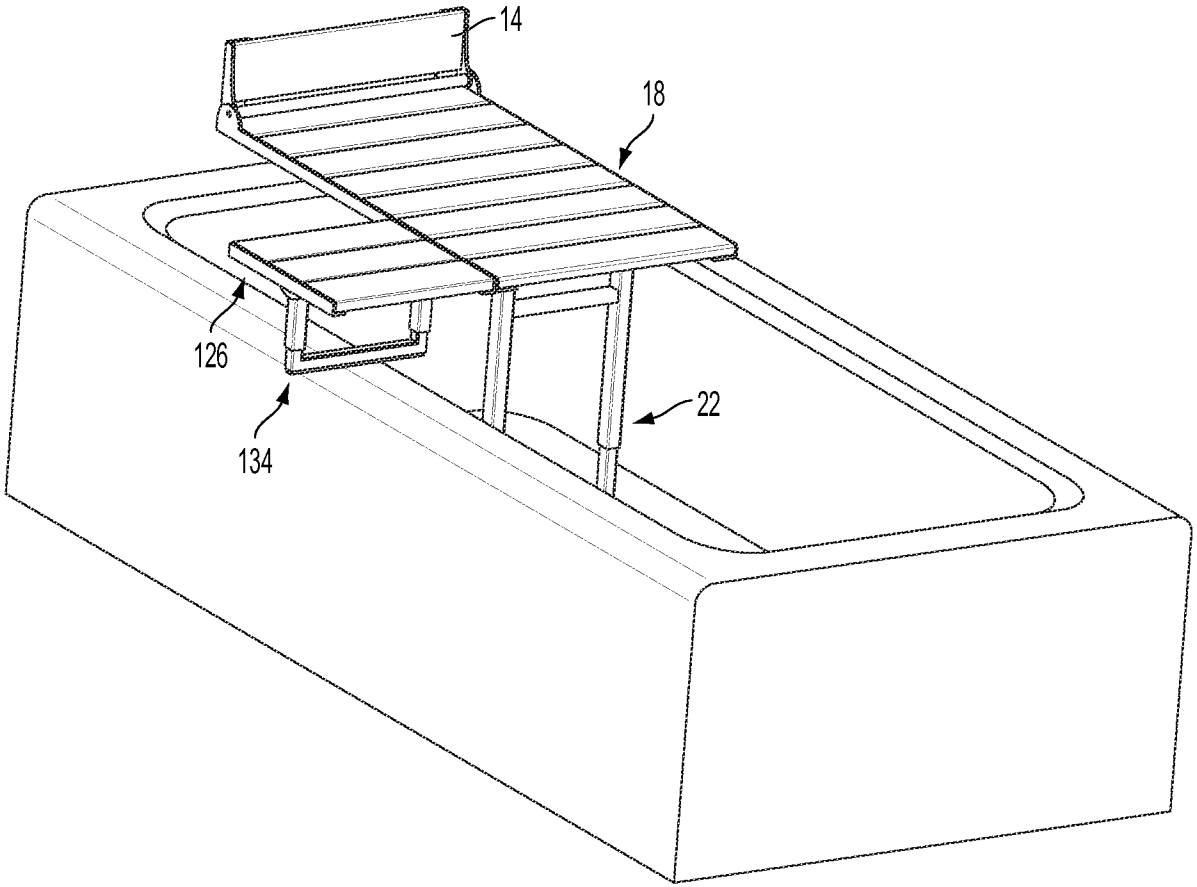
Figure 6D:
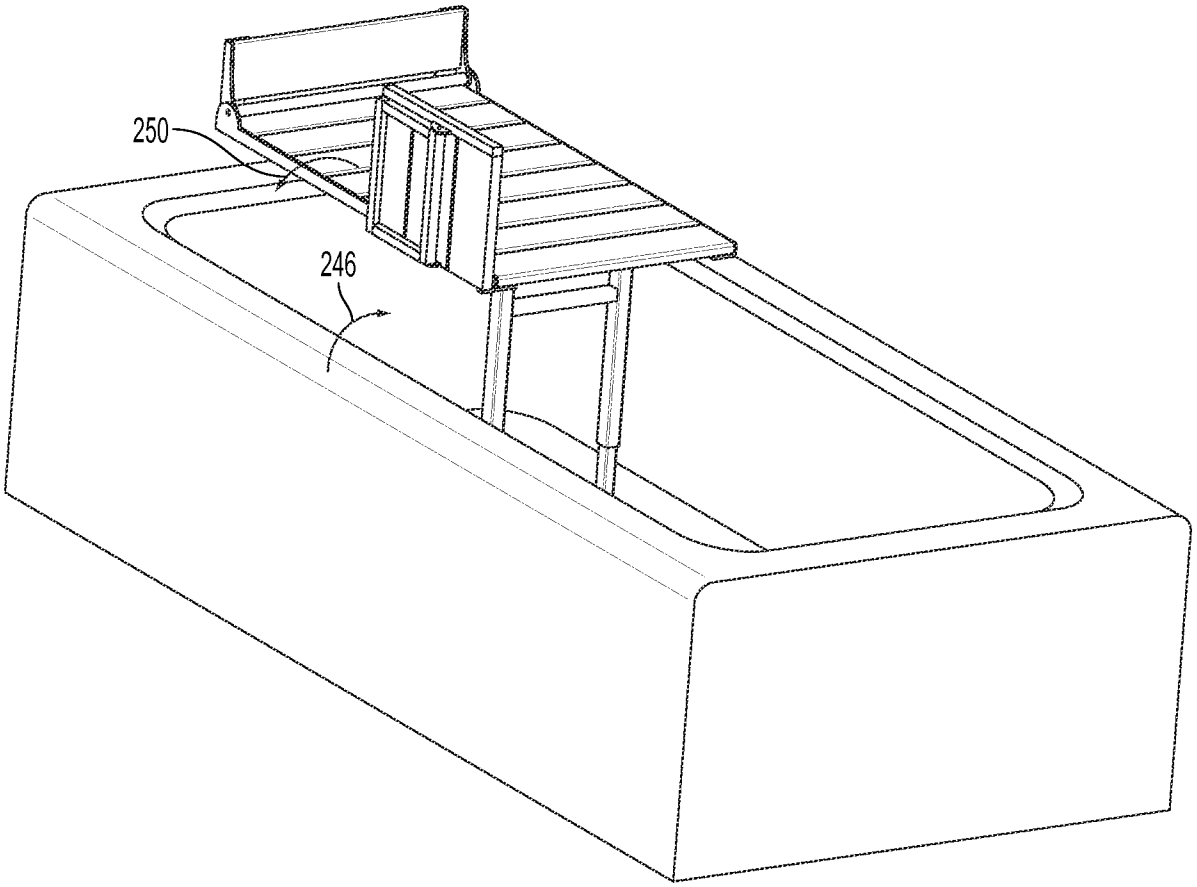
Figure 6E:
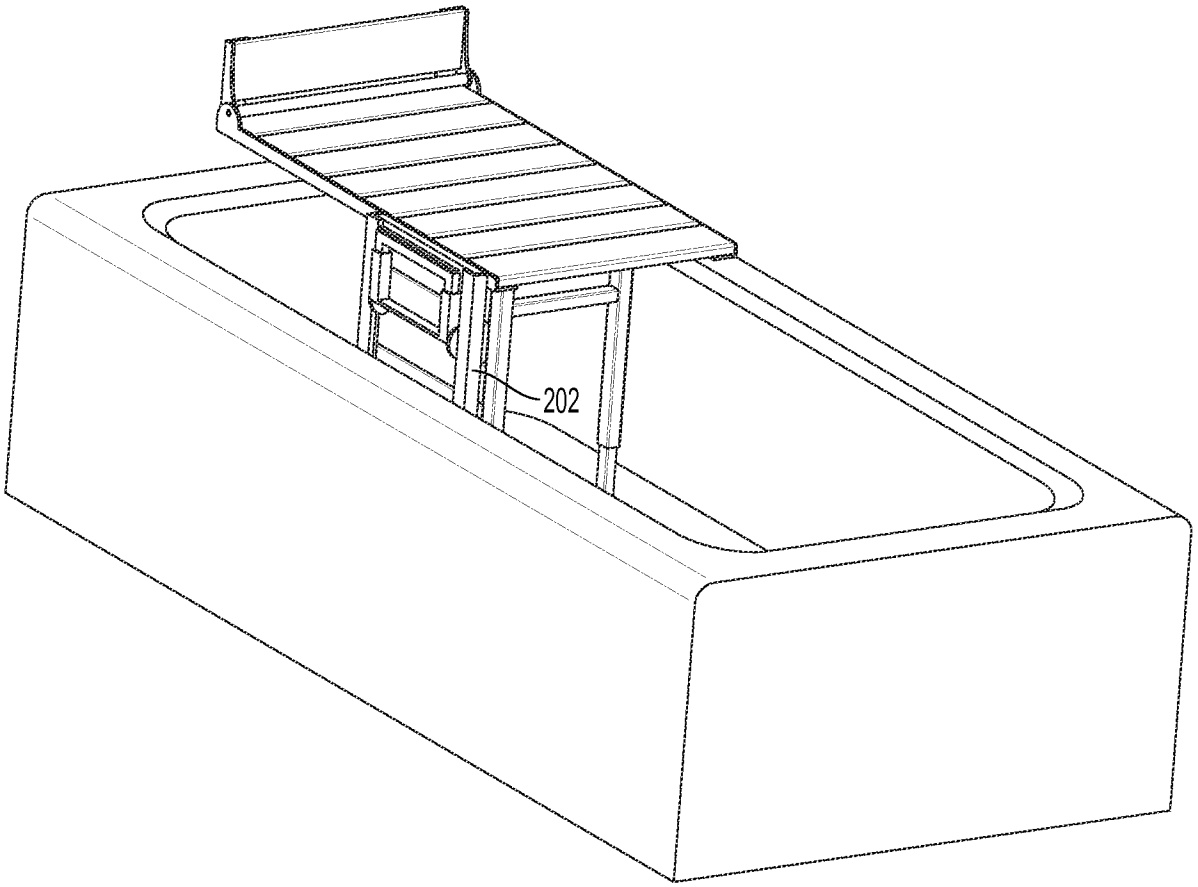

FIGS. 6A-6E depict the function of bench 10 (and other embodiments of the benches with some or all of the same types of functionality described below). FIG. 6A depicts bench mounted to wall 26 above an end 38 (and above a rim 34) of a bathtub 30 with primary leg(s) 22 in their first position in which primary leg(s) 22 are substantially parallel to primary deck 18, with secondary deck 126 in its first position in which secondary deck 126 extends toward second side 78 of primary deck 18 (and is substantially parallel to primary deck 18), and with secondary leg(s) 134 in their first position in which secondary leg(s) 134 are collapsed relative to and substantially parallel to secondary deck 126. In this collapsed configuration, bench 10 extends outwardly less than five inches from the wall, as indicated in FIG. 5. Bench can be secured in this collapsed position by a latch or strap fixed to the wall near the upper end of bench 10, by a latch or strap extending from a flange 54 of mounting member 14 to primary deck 18, or by any other suitable structure that prevents primary deck from pivoting downward to a deployed configuration.

To deploy bench 10 for use, primary deck 18 is pivoted downward in direction 226, away from the wall, as primary leg(s) 22 are pivoted away from primary deck 18 in direction 230 to their second position in which primary leg(s) 22 are substantially perpendicular to primary deck 18. With extension members 122 adjusted to a desired position relative to leg members 114, primary leg(s) 22 extend downward to contact a bottom or floor 234 of the bathtub to support primary deck 18 above the bathtub, such as, for example, with primary deck 18 substantially level, parallel to bottom or floor 138 of the bathtub, and/or perpendicular to the wall to which mounting member 14 is coupled).

With primary deck 18 in the lowered position of FIG. 6B, secondary deck or transfer bench 126 can be deployed from its collapsed state by pivoting secondary deck 126 away from primary deck 18 in direction 238 to its second position of FIG. 6C in which secondary deck 126 extends away from second side 78 of primary deck 18 (and is substantially parallel to primary deck 18). As secondary deck 126 is pivoted, secondary leg(s) 134 can be pivoted away from secondary deck 126 in direction 242 to their second position shown in FIG. 6 in which secondary leg(s) 134 are substantially perpendicular to secondary deck 126 (and can support secondary deck 126 above rim 34, as shown). In the configuration of FIG. 6C in which primary deck 18 and secondary deck 126 are both deployed, a user can sit on secondary deck 126, swing his or her legs over rim 34 of the bathtub, and slide or otherwise move his or her body to be sitting on primary deck 18.

Once the user is positioned fully within the bathtub, secondary leg(s) 134 can be collapsed relative to secondary deck 126 and secondary deck can be pivoted upward in direction 246 to an intermediate position in which secondary deck 126 extends upward from and perpendicular to primary deck 18, as shown in FIG. 6D. From this intermediate position, secondary deck 126 can be pivoted around first pivot axis 214 of hinge 154 in direction 250 to its third position in which secondary deck 126 extends downwardly relative to upper surface 98 of primary deck 18 and at a non-parallel angle to primary deck 18. In this third position, in which secondary deck 126 is collapsed for use instead of storage of bench 10, secondary deck 126 is spaced apart from a lateral rim 34 of a bathtub to permit a shower curtain to pass between bench 10 and lateral rim 34 of the bathtub, such as in space 202. Once a user completes showering or bathing, secondary deck 126 can be returned to its second position of FIG. 6C to facilitate the user's exit from the bathtub, at which point secondary deck 126 can be returned to its first position, and bench 10 returned to its collapsed configuration of FIG. 6A for storage in the reverse of the steps described above for deploying bench 10.

Embodiments of dual-axis hinges (154, 154*a*) can also be used in embodiments of the bath benches that do not fold relative to a wall. For example, in such embodiments, a bench can include one or more (e.g., four) primary legs 22 that are configured to support primary deck 18 over a portion of a bathtub independently of a mounting member (such that mounting member 14 may be omitted).

The above specification and examples provide a complete description of the structure and use of illustrative embodiments. Although certain embodiments have been described above with a certain degree of particularity, or with reference to one or more individual embodiments, those skilled in the art could make numerous alterations to the disclosed embodiments without departing from the scope of this invention. As such, the various illustrative embodiments of the devices are not intended to be limited to the particular forms disclosed. Rather, they include all modifications and alternatives falling within the scope of the claims, and embodiments other than the one shown may include some or all of the features of the depicted embodiment. For example, components may be omitted or combined as a unitary structure, and/or connections may be substituted. For example, in some embodiments, the frame members begin separate and are welded together; in other embodiments, frame members may be unitary such that a single member is only partially cut and bent as a single piece to define a multiple frame portions of the base. Further, where appropriate, aspects of any of the examples described above may be combined with aspects of any of the other examples described to form further examples having comparable or different properties and addressing the same or different problems. Similarly, it will be understood that the benefits and advantages described above may relate to one embodiment or may relate to several embodiments.

The claims are not intended to include, and should not be interpreted to include, means-plus- or step-plus-function limitations, unless such a limitation is explicitly recited in a given claim using the phrase(s) "means for" or "step for," respectively.

The invention claimed is:

1. An apparatus comprising:

a mounting member;

a primary deck having a first end pivotally coupled to the mounting member, a second end, a first side, a second side, a primary deck width between the first and second sides, and a primary deck length between the first and second ends that is greater than the width;

one or more telescoping primary legs pivotally coupled to the primary deck and configured to be moved between (i) a first position in which the one or more primary legs are substantially parallel to the primary deck, and (ii) a second position in which the one or more primary legs are substantially perpendicular to the primary deck;

a secondary deck pivotally coupled to the first side of the primary deck and movable between at least: (i) a first position in which the secondary deck extends toward the second side of the primary deck, and (ii) a second position in which the secondary deck extends away from the second side of the primary deck, the secondary deck having a secondary deck side that is farthest from and a fixed distance from the second side of the primary deck when the secondary deck is in its second position, the secondary deck having a secondary deck width that is aligned or parallel with the primary deck width and less than the primary deck width, the secondary deck also having a secondary deck length parallel to and less than the primary deck length; and one or more secondary legs pivotally coupled to the secondary deck and configured to be moved between (i) a first position in which the one or more secondary legs are substantially parallel to the secondary deck, and (ii) a second position in which the one or more secondary legs are substantially perpendicular to the secondary deck, the one or more secondary legs comprising a cross member parallel to the secondary deck width;

where the mounting member is configured to be coupled to a wall bordering an end of a bathtub above an upper rim of the bathtub such that the primary deck pivots relative to the mounting member around a pivot axis that is substantially perpendicular to the primary deck length, and the primary legs, in their second position, can extend downward from the bottom of the primary deck to a floor of the bathtub to support the primary deck; and where the one or more telescoping primary legs have an extended position in which a location on a bottommost portion of the one or more telescoping primary legs is a first distance from a location on a top surface of the primary deck along a line perpendicular to the primary deck length, the cross member of the one or more secondary legs has a location on a bottommost portion when the one or more secondary legs are in their second position that is a second distance from a location on a top surface of the secondary deck along a line that is perpendicular to the primary deck length when the secondary deck is in its second position, and the first distance is greater than the second distance.

2. The apparatus of claim 1, where the one or more secondary legs comprise one or more telescoping legs, and the one or more telescoping legs comprise the cross member.

3. The apparatus of claim 1, where the secondary deck is further movable to a third position in which the secondary deck extends downwardly relative to an upper surface of the primary deck and at a non-parallel angle to the primary deck.

4. The apparatus of claim 3, where the one or more secondary legs of the secondary deck, when the secondary deck is in its third position, are positioned farther from the second side of the primary deck than is the top surface of the secondary deck.

5. The apparatus of claim 4, where the second distance is less than the secondary deck length.

6. An apparatus comprising:

a mounting member;

a primary deck having a first end pivotally coupled to the mounting member, a second end, a first side, a second side, a width between the first and second sides, and a primary deck length between the first and second ends;

one or more primary legs pivotally coupled to the primary deck and configured to be moved between (i) a first position in which the one or more primary legs are substantially parallel to the primary deck, and (ii) a second position in which the one or more primary legs are substantially perpendicular to the primary deck;

a secondary deck pivotally coupled to the first side of the primary deck and movable between at least: (i) a first position in which the secondary deck extends toward the second side of the primary deck, and (ii) a second position in which the secondary deck extends away from the second side of the primary deck, the secondary deck having a first end that is offset from the first end of the primary deck, a second end that is aligned with the second end of the primary deck, two secondary deck sides between the first and second ends of the secondary deck, and a secondary deck width between the two secondary deck sides that is less than the width of the primary deck; and one or more secondary legs pivotally coupled to the secondary deck and configured to be moved between (i) a first position in which the one or more secondary legs are substantially parallel to the secondary deck, and (ii) a second position in which the one or more secondary legs are substantially perpendicular to the secondary deck;

where the mounting member is configured to be coupled to a wall bordering an end of a bathtub above an upper rim of the bathtub such that the primary deck pivots relative to the mounting member around a pivot axis that is substantially perpendicular to the primary deck length, and the primary legs, in their second position, can extend downward from the bottom of the primary deck to a floor of the bathtub to support the primary deck; and where, when the one or more primary legs are in their second position, the secondary deck is in its second position, and the one or more secondary legs are in their second position, the one or more primary legs and the one or more secondary legs are substantially aligned along a line that is substantially perpendicular to the primary deck length.

7. The apparatus of claim 6, where the one or more secondary legs comprise a cross member parallel to the secondary deck width.

8. The apparatus of claim 6, where the one or more secondary legs comprise one or more telescoping legs, and the one or more telescoping legs comprise the cross member.

9. The apparatus of claim 6, where the secondary deck is further movable to a third position in which the secondary deck extends downwardly relative to an upper surface of the primary deck and at a non-parallel angle to the primary deck.

10. The apparatus of claim 9, where the one or more secondary legs of the secondary deck, when the secondary deck is in its third position, are positioned farther from the second side of the primary deck than is a top surface of the secondary deck.

11. The apparatus of claim 6, further comprising a dual-axis hinge pivotally coupling the secondary deck to the primary deck.

* * * * *